US007939134B2

(12) United States Patent
Verdonck et al.

(10) Patent No.: US 7,939,134 B2
(45) Date of Patent: May 10, 2011

(54) METHOD FOR GUMMING A LITHOGRAPHIC PRINTING PLATE

(75) Inventors: Emiel Verdonck, Berlaar (BE); Joseph Vander Aa, Rijmenam (BE)

(73) Assignee: Agfa Graphics NV, Mortsel (BE)

( * ) Notice: Subject to any disclaimer, the term of this patent is extended or adjusted under 35 U.S.C. 154(b) by 545 days.

(21) Appl. No.: 12/158,102

(22) PCT Filed: Dec. 5, 2006

(86) PCT No.: PCT/EP2006/069293

§ 371 (c)(1),
(2), (4) Date: Jun. 19, 2008

(87) PCT Pub. No.: WO2007/071549

PCT Pub. Date: Jun. 28, 2007

(65) Prior Publication Data

US 2008/0305263 A1 Dec. 11, 2008

Related U.S. Application Data

(60) Provisional application No. 60/756,011, filed on Jan. 4, 2006.

(30) Foreign Application Priority Data

Dec. 20, 2005 (EP) ..... 05112502

(51) Int. Cl.
*B41N 3/08* (2006.01)

(52) U.S. Cl. ..... 427/265; 427/256; 427/258; 427/261; 427/271; 427/277; 427/278; 427/287; 101/453; 101/454; 101/459; 101/463.1; 101/464

(58) Field of Classification Search ..... 427/256, 427/258, 261, 265, 271, 277, 278, 287; 101/453, 101/454, 459, 463.1, 464
See application file for complete search history.

(56) References Cited

U.S. PATENT DOCUMENTS

2004/0051768 A1 * 3/2004 DeBoer et al. ..... 347/106

FOREIGN PATENT DOCUMENTS

EP 1366898 A2 * 12/2003
EP 1 524 113 A 4/2005

OTHER PUBLICATIONS

Official communication issued in the International Application No. PCT/EP2006/069293, mailed on Feb. 6, 2007.

* cited by examiner

*Primary Examiner* — Michael Kornakov
*Assistant Examiner* — Lisha Jiang
(74) *Attorney, Agent, or Firm* — Keating & Bennett, LLP

(57) ABSTRACT

A method for gumming a lithographic printing plate includes the steps of a) providing a lithographic printing plate including a lithographic image consisting of printing areas and non-printing areas, and b) jetting a gum solution with an inkjet printer to produce a hydrophilic protective layer on the non-printing areas. An inkjet printer includes a gum solution for producing a hydrophilic protective layer on the non-printing areas and a fluid for the formation of the printing areas of a lithographic image on a lithographic printing plate precursor.

10 Claims, No Drawings

METHOD FOR GUMMING A LITHOGRAPHIC PRINTING PLATE

CROSS-REFERENCE TO RELATED APPLICATIONS

This application is a 371 National Stage Application of PCT/EP2006/069293, filed Dec. 5, 2006. This application claims the benefit of U.S. Provisional Application No. 60/756,011, filed Jan. 4, 2006, which is incorporated by reference herein in its entirety. In addition, this application claims the benefit of European Application No. 05112502.9, filed Dec. 20, 2005, which is also incorporated by reference herein in its entirety.

BACKGROUND OF THE INVENTION

1. Field of the Invention

The present invention relates to a method for gumming a lithographic printing plate. In particular, the present invention relates to a method wherein a hydrophilic protective layer is jetted on the lithographic printing plate.

2. Description of the Related Art

In lithographic printing, a so-called printing master such as a printing plate is mounted on a cylinder of the printing press. The master carries a lithographic image on its surface and a printed copy is obtained by applying ink to the image and then transferring the ink from the master onto a receiver material, which is typically paper.

Different technologies can be used to manufacture lithographic printing plates, e.g., conventional pre-sensitized lithographic printing plates bearing a UV sensitive coating, thermal plates that are sensitive to heat or infrared light, and more recently lithographic printing plates manufactured using inkjet printing technology.

In the final process of making a lithographic printing plate, "gumming up" is conducted in which a finisher (so-called "gum solution") is applied onto the surface of the lithographic printing plate in order to protect the non-image (i.e., non-printing) areas thereof. The gum solution is typically applied to the printing plate by immersion of the printing plate in a bath of gum solution, e.g., in an automatic developing machine, or by spraying or jetting the gum as disclosed in EP 1524113 A (AGFA).

Such a gumming up step is performed for various purposes, for instance: for enhancing the hydrophilicity of the non-printing areas of the lithographic printing plate; for preventing the deterioration of the lithographic printing plate during the storage of the plate prior to printing operations or during the interruption period of the printing operations; for preventing the contamination of the lithographic printing plate with grease from fingers or hands or ink during handling the plate, which is often observed, for instance, when the plate is mounted to a printing press and hence for preventing the non-printing areas of the plate from being made ink receptive; and for preventing possible defects from appearing on the printing or non-printing areas thereof during handling the same.

A special type of gum solution, called baking gum, is used for protecting the plate during the baking step. A baking step involves heating of the plate so as to increase the run length during printing.

Once mounted on a printing press, the protective layer formed by the gum solution is removed from the lithographic printing plate by the fountain solution or the printing ink. It can be difficult, during printing, to adhere ink to the printing areas to which a thick layer of the gum solution is applied. For this reason, it takes a long period of time to obtain printed matters having a desired ink density. On the other hand, it is observed that the hydrophilicity is lowered in the non-printing areas to which a thin layer of the gum solution is applied. In this case, the non-printing areas are easily contaminated and hence cause background contamination of printed matters.

SUMMARY OF THE INVENTION

There is therefore an unmet need to provide an improved method for gumming a lithographic printing plate.

In order to overcome the problems described above, preferred embodiments of the present invention provide a method for gumming a lithographic printing plate showing a rapid adhesion of ink to the printing areas (fast clean-out) and a high hydrophilicity of the non-printing areas.

The various preferred embodiments of the present invention provide a method for gumming a lithographic printing plate showing an increased efficiency after an interruption period of the printing operations.

The various preferred embodiments of the present invention provide an inkjet printer for gumming a lithographic printing plate.

These and other advantages of the present invention will become apparent from the description hereinafter.

It was discovered, that by controlling independently the thickness of the layer formed on the printing plate by the gum solution on printing and non-printing areas, that it is possible to reduce the number of revolutions of the plate cylinder of a printing press for obtaining printed matters having the desired ink density and a clean background. No deterioration was observed in the image quality by handling lithographic plates in which no gum solution was applied to the printing areas.

Advantages of the preferred embodiments of the present invention are achieved with a method for gumming a lithographic printing plate including the steps of: a) providing a lithographic printing plate including a lithographic image consisting of printing areas and non-printing areas, and b) jetting a gum solution with an inkjet printer to produce a hydrophilic protective layer on the non-printing areas.

Advantages of preferred embodiments of the present invention are also achieved with an inkjet printer including a gum solution for producing a hydrophilic protective layer on the non-printing areas and a fluid for the formation of the hydrophobic printing areas of a lithographic image on a lithographic printing plate precursor.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

Definitions

The term "lithographic printing plate" as used in the preferred embodiments of the present invention, means a plate with a surface on which the image to be printed is ink-receptive and the non-image area is ink-repellent.

The term "printing areas" as used in the preferred embodiments of the present invention, means the areas of the image on a lithographic printing plate that are ink-receptive.

The term "non-printing areas" as used in the preferred embodiments of the present invention, means the areas of the image on a lithographic printing plate that are ink-repellent.

The term "lithographic printing plate precursor" as used in the preferred embodiments of the present invention means any plate with a surface capable of forming a lithographic image.

The term "lithographic image" as used in the preferred embodiments of the present invention means an image on a lithographic printing plate consisting of printing areas and non-printing areas.

Gumming

In a method for gumming a lithographic printing plate according to a preferred embodiment of the present invention, a gum solution is jetted on a lithographic printing plate including a lithographic image consisting of printing areas and non-printing areas. The jetted gum solution forms a hydrophilic protective layer. The thickness of the hydrophilic protective layer on the non-printing areas is preferably greater than the thickness of the hydrophilic protective layer on the printing areas.

In a preferred embodiment of the method for gumming a lithographic printing plate according to the present invention, a gum solution is jetted solely on the non-printing areas of a lithographic printing plate including a lithographic image consisting of printing areas and non-printing areas.

The gumming can be performed off-press, but also on-press.

On-press gumming is particularly useful when printing has to be interrupted. The lithographic printing plates remain mounted in perfect registration on the printing press, which makes it possible to jet gum solution solely to the non-printing areas if the lithographic image of each plate is electronically available. When printing is resumed, no removal of gum solution is required from the printing areas, and hence waste is reduced since printed matters reach the desired ink density immediately.

Another method for jetting a gum solution only or almost only on the non-printing areas of a lithographic printing plate is by using a device in the inkjet printer for detecting the non-printing areas. The printing areas may contain a compound whereby printing areas can be differentiated from non-printing areas. For example, a colorant may be present in the printing areas on the lithographic printing plate and is detected by an optical measurement device (e.g., measurement of the amount of reflected light in a certain wavelength range wherein the colorant has a high absorption for light). On detection, a signal is sent to the print head to apply no or less gum solution to this area on the printing plate. When no colorant is detected, gum solution is applied. In a preferred set-up of the inkjet printer, the optical measurement device moves together with the inkjet print head.

Gumming may also be performed in combination with the use of a roller treatment to further improve the clean-out properties. The roller treatment may include transporting the jetted samples through a pair of pressing rollers. This extra step is carried out before the drying step. The drying of the jetted gum solution may be conducted by drying by air at room temperature, but it may be combined with a heat treatment, for example, at 120° C. for 30 minutes.

Gum Solution

The gum solution suitable for use in a method for gumming a lithographic printing plate according to a preferred embodiment of the present invention is an aqueous liquid, which includes one or more surface protective compounds that are capable of protecting the lithographic image of a printing plate against contamination or damaging. Suitable examples of such compounds are film-forming hydrophilic polymers and surfactants. The hydrophilic protective layer that remains on the plate after treatment with the gum solution preferably includes between 0.1 and 20 g/m$^2$ of the surface protective compound, particularly preferably between 0.15 and 0.3 g/m$^2$ of the surface protective compound.

For jetting with an inkjet printer, the viscosity of the gum solution is preferably lower than 100 mPa·s, more preferably lower than 50 mPa·s, and most preferably lower than 30 mPa·s at a shear rate of 100 s$^{-1}$ and a temperature between 20 and 70° C.

A special type of gum solution is a baking gum solution having a similar composition as a standard gum solution, but with the additional preference towards compounds that do not evaporate at the usual bake temperatures.

Specific examples of suitable baking gum solutions are described in, e.g., U.S. Pat. No. 4,983,478 (HOECHST), EP 1025992 A (AGFA), GB 1555233 (HOECHST) and U.S. Pat. No. 4,786,581 (HOECHST).

After applying the baking gum solution, the plate can be dried before baking or is dried during the baking process itself. The baking process can proceed at a temperature between 100° C. and 230° C. for a period of 5 to 40 minutes. For example, a lithographic printing plate jetted upon with a baking gum can be baked at a temperature of 230° C. for 5 minutes, at a temperature of 150° C. for 10 minutes or at a temperature of 120° C. for 30 minutes. Baking can be done in conventional hot air ovens or by irradiation with lamps emitting in the infrared or ultraviolet spectrum.

Hydrophilic Polymer

The hydrophilic polymers suitable as surface protective compounds in the gum solution for use in a method for gumming a lithographic printing plate according to a preferred embodiment of the present invention, are polymers including ionic or ionizable groups or containing polyethyleneoxide groups.

Examples of ionic or ionizable groups are acid groups or salts thereof such as carboxylic acid group, sulphonic acid, phosphoric acid or phosphonic acid. The acid groups in the polymer may be neutralized with an organic amine (e.g., ammonia, triethylamine, tributylamine, dimethylethanolamine, diisopropanolamine, morpholine, diethanolamine or triethanolamine) or an alkali metal (e.g., lithium, sodium or potassium). The polymer may be composed of a monomer including an anionic group. The polymer may also be composed of two or more different types of monomers including anionic and/or non-ionic groups. Specific examples of monomers including anionic groups are (meth)acrylic acid, crotonic acid, (meth)acrylic acid, propyl(meth)acrylic acid, isopropyl(meth)acrylic acid, itaconic acid, fumaric acid, sulfoethyl(meth)acrylate, butyl(meth)acrylamidesulfonic acid and phosphoethyl(meth)acrylate. In general, the number average molecular weight of the polymer is preferably in the range of about 1,000 to 3,000,000 g/mol.

Preferred polymers for use as the protective compound in the gum solution suitable for use in a method for gumming a lithographic printing plate according to a preferred embodiment of the present invention, are gum arabic, pullulan, cellulose derivatives such as carboxymethylcellulose, carboxyethylcellulose or methylcellulose, (cyclo)dextrin, poly(vinyl alcohol), poly(vinyl pyrrolidone), polysaccharide, homo- and copolymers of acrylic acid, methacrylic acid or acrylamide, a copolymer of vinyl methyl ether and maleic anhydride, a copolymer of vinyl acetate and maleic anhydride or a copolymer of styrene and maleic anhydride. Highly preferred polymers are homo- or copolymers of monomers containing carboxylic, sulfonic or phosphonic groups or the salts thereof, e.g., (meth)acrylic acid, vinyl acetate, styrene sulfonic acid, vinyl sulfonic acid, vinyl phosphonic acid or acrylamidopropane sulfonic acid.

Surfactants

The gum solution suitable for use in a method for gumming a lithographic printing plate according to a preferred embodiment of the present invention, may include one or more surfactants to improve the surface properties of the jetted hydrophilic protective layer. The surfactant may be an anionic or a non-ionic surfactant.

Examples of anionic surfactants include aliphates, abietates, hydroxyalkanesulfonates, alkanesulfonates, dialkylsulfosuccinates, straight-chain alkylbenzenesulfonates, branched alkylbenzenesulfonates, alkylnaphthalenesulfonates, alkylphenoxypolyoxyethylenepropylsulfonates, salts of polyoxyethylene alkylsulfophenyl ethers, sodium N-methyl-N-oleyltaurates, monoamide disodium N-alkylsulfosuccinates, petroleum sulfonates, sulfated castor oil, sulfated tallow oil, salts of sulfuric esters of aliphatic alkylesters, salts of alkylsulfuric esters, sulfuric esters of polyoxyethylenealkylethers, salts of sulfuric esters of aliphatic monoglycerides, salts of sulfuric esters of polyoxyethylenealkylphenylethers, salts of sulfuric esters of polyoxyethylenestyrylphenylethers, salts of alkylphosphoric esters, salts of phosphoric esters of polyoxyethylenealkylethers, salts of phosphoric esters of polyoxyethylenealkylphenylethers, partially saponified compounds of styrenemaleic anhydride copolymers, partially saponified compounds of olefin-maleic anhydride copolymers, and naphthalenesulfonateformalin condensates. Particularly preferred among these anionic surfactants are dialkylsulfosuccinates, salts of alkylsulfuric esters and alkylnaphthalenesulfonates.

Specific examples of suitable anionic surfactants include sodium dodecylphenoxybenzene disulfonate, the sodium salt of alkylated naphthalenesulfonate, disodium methylene-dinaphthalene-disulfonate, sodium dodecyl-benzenesulfonate, sulfonated alkyl-diphenyloxide, ammonium or potassium perfluoroalkylsulfonate and sodium dioctyl-sulfosuccinate.

Suitable examples of the non-ionic surfactants include polyoxyethylene alkyl ethers, polyoxyethylene alkyl phenyl ethers, polyoxyethylene polystyryl phenyl ethers, polyoxyethylene polyoxypropylene alkyl ethers, polyoxyethylene polyoxypropylene block polymers, partial esters of glycerinaliphatic acids, partial esters of sorbitanaliphatic acid, partial esters of pentaerythritolaliphatic acid, propyleneglycolmonoaliphatic esters, partial esters of sucrosealiphatic acids, partial esters of polyoxyethylenesorbitanaliphatic acid, partial esters of polyoxyethylenesorbitolaliphatic acids, polyethyleneglycolaliphatic esters, partial esters of poly-glycerinaliphatic acids, polyoxyethylenated castor oils, partial esters of polyoxyethyleneglycerinaliphatic acids, aliphatic diethanolamides, N,N-bis-2-hydroxyalkylamines, polyoxyethylene alkylamines, triethanolaminealiphatic esters, and trialkylamine oxides. Particularly preferred among these non-ionic surfactants are polyoxyethylene alkylphenyl ethers and poloxyethylene-polyoxypropylene block polymers. Further, fluorinic and siliconic anionic and non-ionic surfactants may be similarly used.

Two or more of the above surfactants may be used in combination. For example, a combination of two or more different anionic surfactants or a combination of an anionic surfactant and a non-ionic surfactant may be preferred. The amount of such a surfactant is not specifically limited but is preferably from 0.01 to 20 wt %.

The surface tension of the gum solution is preferably from 20 to 50 mN/m, more preferably from 25 to 35 mN/m.

pH Control Agents

A pH control agent may also be present in the gum solution suitable for use in a method for gumming a lithographic printing plate according to a preferred embodiment of the present invention. The gum solution preferably has a pH from 2 to 8, more preferably from 3 to 6. The pH of the gum solution is usually adjusted with a mineral acid, an organic acid or an inorganic salt in an amount of from 0.01 to 2 wt %.

Examples of the mineral acids include nitric acid, sulfuric acid, phosphoric acid and metaphosphoric acid. Especially organic acids are used as pH control agents and as desensitizing agents. Examples of the organic acids include carboxylic acids, sulfonic acids, phosphonic acids or salts thereof, e.g., succinates, phosphates, phosphonates, sulfates and sulfonates. Specific examples of the organic acid include citric acid, acetic acid, oxalic acid, malonic acid, p-toluenesulfonic acid, tartaric acid, malic acid, lactic acid, levulinic acid, phytic acid and organic phosphonic acid.

Examples of the inorganic salt include magnesium nitrate, monobasic sodium phosphate, dibasic sodium phosphate, nickel sulfate, sodium hexametaphosphate and sodium tripolyphosphate. Other inorganic salts can be used as corrosion inhibiting agents, e.g., magnesium sulfate or zinc nitrate.

The mineral acid, organic acid or inorganic salt may be used singly or in combination with one or more thereof.

Wetting Agents

A wetting agent may also be present in the gum solution suitable for use in a method for gumming a lithographic printing plate according to a preferred embodiment of the present invention.

Examples of the wetting agent include ethylene glycol, propylene glycol, triethylene glycol, butylene glycol, hexylene glycol, diethylene glycol, dipropylene glycol, glycerin, trimethylol propane and diglycerin.

The wetting agent may be used singly or in combination with one or more thereof.

In general, the foregoing wetting agent is preferably used in an amount of from 0.1 to 25 wt %.

Chelate Compounds

A chelate compound may also be present in the gum solution suitable for use in a method for gumming a lithographic printing plate according to a preferred embodiment of the present invention. Calcium ion and other impurities contained in the gum solution can have adverse effects on printing and thus cause the contamination of printed matter. Adding a chelate compound to the gum solution can eliminate this problem.

Preferred examples of such a chelate compound include organic phosphonic acids or phosphonoalkanetricarboxylic acids. Specific examples are potassium or sodium salts of ethylenediaminetetraacetic acid, diethylenetriaminepentaacetic acid, triethylenetetraminehexaacetic acid, hydroxyethylethylenediaminetriacetic acid, nitrilotriacetic acid, 1-hydroxyethane-1,l-diphosphonic acid and aminotri(methylenephosphonic acid). Besides these sodium or potassium salts of these chelating agents, organic amine salts are useful.

The preferred amount of such a chelating agent to be added is from 0.001 to 1.0 wt % relative to the gum solution.

Antiseptic Agents

An antiseptic agent may also be present in the gum solution suitable for use in a method for gumming a lithographic printing plate according to a preferred embodiment of the present invention.

Examples of such an antiseptic include phenol, derivatives thereof, formalin, imidazole derivatives, sodium dehydroacetate, 4-isothiazoline-3-one derivatives, benzoisothiazoline-3-one, benztriazole derivatives, amidineguanidine derivatives, quaternary ammonium salts, pyridine derivatives, quinoline derivatives, guanidine derivatives, diazine, triazole derivatives, oxazole and oxazine derivatives.

The preferred amount of such an antiseptic to be added is such that it can exert a stable effect on bacteria, fungi, yeast or the like. Though depending on the kind of bacteria, fungi and yeast, it is preferably from 0.01 to 4 wt % relative to the gum solution.

Further, preferably, two or more antiseptics may be used in combination to exert an aseptic effect on various fungi and bacteria.

Anti-Foaming Agents

An anti-foaming agent may also be present in the gum solution suitable for use in a method for gumming a lithographic printing plate according to a preferred embodiment of the present invention.

The anti-foaming agent is preferably a silicone anti-foaming agent. Among these anti-foaming agents, either an emulsion dispersion type or a solubilized type anti-foaming agent may be used.

The proper amount of such an anti-foaming agent to be added is from 0.001 to 1.0 wt % relative to the gum solution.

Ink Receptivity Agents

An ink receptivity agent may also be present in the gum solution suitable for use in a method for gumming a lithographic printing plate according to a preferred embodiment of the present invention, to ensure a rapid adhesion of printing ink. This is especially useful when gum solution is also jetted on the printing areas of the lithographic printing plate. If the gum solution is solely jetted on the non-printing areas, then preferably no ink receptivity agent is present in the gum solution.

Examples of such an ink receptivity agent include turpentine oil, xylene, toluene, low heptane, solvent naphtha, kerosine, mineral spirit, hydrocarbons such as petroleum fraction having a boiling point of about 120° C. to about 250° C., diester phthalates (e.g., dibutyl phthalate, diheptyl phthalate, di-n-octyl phthalate, di(2-ethylhexyl) phthalate, dinonyl phthalate, didecyl phthalate, dilauryl phthalate, butylbenzyl phthalate), aliphatic dibasic esters (e.g., dioctyl adipate, butylglycol adipate, dioctyl azelate, dibutyl sebacate, di(2-ethylhexyl) sebacate dioctyl sebacate), epoxidated triglycerides (e.g., epoxy soybean oil), ester phosphates (e.g., tricresyl phosphate, trioctyl phosphate, trischloroethyl phosphate) and plasticizers having a solidification point of 15° C. or less and a boiling point of 300° C. or more at one atmospheric pressure such as esters of benzoates (e.g., benzyl benzoate).

Examples of other ink receptivity agents include ketones (e.g., cyclohexanone), halogenated hydrocarbons (e.g., ethylene dichloride), ethylene glycol ethers (e.g., ethylene glycol monomethyl ether, ethylene glycol monophenyl ether, ethylene glycol monobutyl ether), aliphatic acids (e.g., caproic acid, enathic acid, caprylic acid, pelargonic acid, capric acid, undecylic acid, lauric acid, tridecylic acid, myristic acid, pentadecylic acid, palmitic acid, heptadecylic acid, stearic acid, nonadecanic acid, arachic acid, behenic acid, lignoceric acid, cerotic acid, heptacosanoic acid, montanic acid, melissic acid, lacceric acid, isovaleric acid) and unsaturated aliphatic acids (e.g., acrylic acid, crotonic acid, isocrotonic acid, undecyclic acid, oleic acid, elaidic acid, cetoleic acid, erucic acid, butecidic acid, sorbic acid, linoleic acid, linolenic acid, arachidonic acid, propiolic acid, stearolic acid, clupanodonic acid, tariric acid, licanic acid). Preferably, it is an aliphatic acid, which is liquid at a temperature of 50° C., more preferably it has from 5 to 25 carbon atoms, most preferably it has from 8 to 21 carbon atoms.

The ink receptivity agent may be used singly or in combination with one or more thereof. The ink receptivity agent is preferably used in an amount of from 0.01 to 10 wt %, more preferably from 0.05 to 5 wt %. The foregoing ink receptivity agent may be present as an oil-in-water emulsion or may be solubilized with the aid of a solubilizing agent.

Lithographic Printing Plate

The lithographic printing plate suitable for use in a method for gumming a lithographic printing plate according to a preferred embodiment of the present invention may be produced from a radiation-sensitive lithographic printing plate precursor, from a heat-sensitive lithographic printing plate precursor and by inkjet printing on a printing plate precursor.

The lithographic printing plate precursors used in a method of a preferred embodiment of the present invention develop a lithographic image consisting of hydrophobic and hydrophilic areas. The hydrophilic areas are defined by the support, which has a hydrophilic surface or is provided with a hydrophilic layer.

Suitable lithographic printing plates produced from a radiation-sensitive lithographic printing plate precursor include conventional pre-sensitized lithographic printing plate precursors bearing a UV-sensitive coating based on photopolymer or diazonium chemistry. The plate precursor has to be UV-exposed through a mask carrying the image. The mask is usually a graphic arts film prepared by photographic techniques based on silver halide chemistry and involving exposure by a camera or by an image-setter, and further involving wet processing.

Suitable lithographic printing plates produced from a heat-sensitive lithographic printing plate precursor include thermal plates that are sensitive to heat or infrared light. Such thermal materials may be exposed directly to heat, e.g., by a thermal head, but preferably include a compound that converts absorbed light into heat and are therefore suitable for exposure by lasers, especially infrared laser diodes. The heat, which is generated on image-wise exposure, triggers a (physico-)chemical process, such as ablation, polymerization, insolubilization by cross-linking of a polymer, decomposition, or particle coagulation of a thermoplastic polymer latex, and after optional processing, a lithographic image is obtained. Many thermal plate materials are based on heat-induced coagulation of thermoplastic polymer particles.

Suitable lithographic printing plates produced by inkjet printing technology include lithographic printing plates, wherein the liquid ink contains an oleophilizing compound for the formation of a printing area on a lithographic support (EP 1157826 A (AGFA), EP 1157827 A (AGFA), EP 1157828 A (AGFA), EP 1211063 A (AGFA), EP 1219415 A (AGFA) and U.S. Pat. No. 6,532,871 (KODAK POLYCHROME GRAPHICS)) or a compound capable of inhibiting the dissolving action by the fountain solution, ink or developer of an image forming layer on a lithographic support (EP 1266750 A (AGFA) and EP 1258349 A (AGFA)). Ink jet printing wherein the ink is a solid or phase change type ink, instead of a liquid or fluid type ink, is described in EP 1266750 A (AGFA) to deposit a hot wax on a surface of an offset plate. Upon cooling of the wax, it solidifies, thereby providing a printing plate.

Lithographic Support

The support may be a sheet-like material such as a plate or it may be a cylindrical element such as a sleeve, which can be slid around a print cylinder of a printing press. Preferably, the support is a metal support such as aluminum or stainless steel.

A particularly preferred lithographic support is an electrochemically grained and anodized aluminum support. The anodized aluminum support may be treated to improve the hydrophilic properties of its surface. For example, the aluminum support may be silicated by treating its surface with a sodium silicate solution at elevated temperature, e.g., 95° C. Alternatively, a phosphate treatment may be applied which involves treating the aluminum oxide surface with a phosphate solution that may further contain an inorganic fluoride. Further, the aluminum oxide surface may be rinsed with a citric acid or citrate solution. This treatment may be carried out at room temperature or may be carried out at a slightly elevated temperature of about 30 to 50° C. A further interesting treatment involves rinsing the aluminum oxide surface with a bicarbonate solution. Still further, the aluminum oxide surface may be treated with polyvinylphosphonic acid, polyvinylmethylphosphonic acid, phosphoric acid esters of polyvinyl alcohol, polyvinylsulfonic acid, polyvinylbenzenesulfonic acid, sulfuric acid esters of polyvinyl alcohol, and acetals of polyvinyl alcohols formed by reaction with a sulfonated aliphatic aldehyde. It is further evident that one or more of these post treatments may be carried out alone or in combination. More detailed descriptions of these treatments are given in U.S. Pat. No. 3,468,725 (KALLE), U.S. Pat. No. 5,637,441 (AGFA), U.S. Pat. No. 5,556,531 (AGFA), U.S. Pat. No. 5,755,949 (AGFA), U.S. Pat. No. 5,314,787 (HOECHST), U.S. Pat. No. 5,156,723 (HOECHST), U.S. Pat. No. 4,840,713 (HOECHST), U.S. Pat. No. 4,897,168 (HOECHST), and U.S. Pat. No. 4,458,005 (HOECHST).

According to another preferred embodiment, the support can also be a flexible support, which may be provided with a hydrophilic layer, hereinafter called 'base layer'. The flexible support is, e.g., paper, plastic film or aluminum. Preferred examples of plastic film are polyethylene terephthalate film, polyethylene naphthalate film, cellulose acetate film, polystyrene film, polycarbonate film, etc. The plastic film support may be opaque or transparent.

The base layer is preferably a cross-linked hydrophilic layer obtained from a hydrophilic binder cross-linked with a hardening agent such as formaldehyde, glyoxal, polyisocyanate or a hydrolyzed tetra-alkylorthosilicate. The latter is particularly preferred. The thickness of the hydrophilic base layer may vary in the range of 0.2 to 25 μm and is preferably 1 to 10 μm. Suitable embodiments of the base layer are also disclosed in EP 1025992 A (AGFA).

Inkjet Printer

The inkjet printer according to a preferred embodiment of the present invention has at least one print head ejecting small droplets of gum solution in a controlled manner through nozzles onto the surface of a lithographic printing plate, which is moving relative to the printing head(s). The ejected or jetted gum solution forms a hydrophilic protective layer on the non-printing areas and optionally the printing areas of the lithographic printing plate.

At high printing speeds, the inks must be ejected readily from the printing heads, which puts a number of constraints on the physical properties of the ink, e.g., a low viscosity at the jetting temperature, which may vary from 20 to 70° C., a surface energy such that the print head nozzle can form the necessary small droplets and a homogenous liquid capable of rapid conversion to a dry printed area.

A preferred print head for jetting the gum solution suitable for use in a method for gumming a lithographic printing plate according to a preferred embodiment of the present invention is a piezoelectric head. Piezoelectric inkjet printing is based on the movement of a piezoelectric ceramic transducer when a voltage is applied thereto. Application of a voltage changes the shape of the piezoelectric ceramic transducer in the print head creating a void, which is then filled with ink. When the voltage is removed, the ceramic expands to its original shape, ejecting a droplet of ink from the print head.

The device for jetting the gum solution suitable for use in a method for gumming a lithographic printing plate according to the present invention is however not restricted to a piezoelectric inkjet print head. Other inkjet printing heads for ink ejection can be used and include various types, such as continuous types and thermal, electrostatic and acoustic drop on demand types.

The gum solution suitable for use in a method for gumming a lithographic printing plate according to a preferred embodiment of the present invention can also be advantageously used in a "single pass printing process". This is a printing mode, which can be performed by using page wide inkjet printing heads or multiple staggered inkjet printing heads that cover the entire width of the ink-receiver surface. In a single pass printing process, the inkjet printing heads usually remain stationary and the ink-receiver surface is transported under the inkjet printing heads. An example of such a single pass inkjet printer is "The Dot Factory" manufactured by AGFA DOTRIX.

In a preferred embodiment, the inkjet printer also includes a device for detecting the non-printing areas. For example, a colorant may be present in the printing areas on the lithographic printing plate in a concentration suitable for detection by an optical measurement device. When colorant is detected, the print head is controlled to jet none or less gum solution to this area on the printing plate, if no colorant is detected the gum solution is applied.

In a preferred embodiment, the inkjet printer according to the present invention contains a device to jet a gum solution and a fluid for the formation of the printing areas of a lithographic image on a lithographic printing plate precursor. Preferably, the gum solution for the non-printing areas is jetted in the same printing process with the fluid used to form the printing areas of a lithographic image on a lithographic printing plate.

According to another preferred embodiment, the gum solution for the non-printing areas and the fluid used to form the printing areas of lithographic image on the lithographic printing plate are jetted by the same inkjet print head.

According to another preferred embodiment, the inkjet printer is mounted on a printing press. For colored printing matter, the printing press usually includes four print cylinders. A plate is mounted on each print cylinder for each of the four printing inks (CMYK); in this case each print cylinder has its separate inkjet printer.

EXAMPLES

Materials

All materials used in the following examples were readily available from Aldrich Chemical Co. (Belgium) unless otherwise specified. The "water" used in the examples was demineralized water. The following materials were used:

Avedex 37LAC19 from AVEBE.
Orthophosphoric acid from Merck.
Glycerol from Fina Chemicals.
DequeSt™ 2000 from Monsanto.
Genapol™ 3520 from Clariant Benelux.
Acticide™ LA 1206 from Thor Overseas.
Potassium hydroxide from Tessenderlo Group.
FS101™ fountain solution from Agfa.
Isopropanol from Caldic Belgium NV.
Skinnex™ X800 black ink from K&E (BASF).
Zonyl™ FSE from DuPont.

Propyleneglycol from Caldic Belgium NV.

Diethyleneglycol from BASF Belgium NV.

Duasyn™ Direct Turquoise Blue FRLSF from Clariant Benelux NV.

SAA is a grained and anodized aluminium substrate. Graining was carried out in a 2 cell grainer using HCl (9.5 and 9.7 g/L respectively)/$CH_3COOH$ (17.6 and 18.5 g/L respectively) as an acid mixture, at a temperature of 26.5° C. and 25.3° C. and voltages of 21 and 22V. Anodization was carried out in 2 cells containing sulfuric acid (129 g/L and 119 g/L respectively) at 45° C. and 46.1° C. and voltages of 25.9V and 25V resulting in an anodic weight of 6.6 g/m$^2$. MAA differs from the method for preparing SAA substrate in that the anodization was carried out in a mixture of $H_3PO_4$ and $H_2SO_4$ (resp. 332 g/L and 52.9 g/L). The temperature of the anodization liquid was 44° C. and the resulting anodic weight was 2.43 g/m$^2$.

Measurement Methods

1. Optical Density

Optical density was measured with a Gretag D19C densitometer with Wratten 47B filter (black values).

2. Printing Quality

The printing quality was investigated by mounting the printing plate on a Heidelberg sheet fed GTO46 offset press using a mixture of 3% FS101™ and 10% isopropanol as a fountain solution. Skinnex X800 black ink was used for printing on Rey Today Office Paper 80 g/m$^2$ delivered by GPG Papier NV. The optical density of the unprinted paper was 0.09.

A good printing quality requires a thorough clean-out in the non-printing areas and a rapid ink-uptake in the printing areas.

A thorough clean-out means that, after a low number of prints, the optical density of a non-printing area on the paper was approximately equal to that of the unprinted paper.

The ink-uptake was evaluated by measuring the optical density of a uniform black printing area on the paper after a number of prints. A rapid ink-uptake means that a high optical print density was obtained after a low number of prints.

3. Fingerprint Test

The sensitivity to contamination in a non-printing area was tested by putting a thumb on the printing plate and investigating if the fingerprint can be found afterwards on the printed paper. If a fingerprint was found, i.e., a high fingerprint sensitivity, the outcome of the test was marked as negative (−). If no fingerprint was found, i.e., low fingerprint sensitivity, the outcome of the test was marked as positive (+).

Example 1

This example illustrates the effect of a jetted gum solution on clean-out.

Two gum solutions were prepared according to Table 1.

TABLE 1

| Component | Gum solution 1 | Gum solution 2 |
|---|---|---|
| Avedex ™ 37AC19 | 116.00 g | 79.70 g |
| Orthophosphoric acid | 1.81 mL | 1.25 mL |
| Glycerol | 5.46 mL | 3.75 mL |
| Dequest ™ 2000 | 7.13 mL | 4.90 mL |
| Genapol ™ 3520 | 0.08 mL | 0.06 mL |
| Acticide ™ LA 1206 | 1.50 mL | 1.08 mL |
| 50% solution of KOH | 2.76 mL | 1.90 mL |
| Propyleneglycol | 204.00 mL | — |
| Diethyleneglycol | 68.00 mL | — |
| Water | to make 1000.00 mL | to make 1000.00 mL |

Print heads of an Epson 900 printer were used to jet the gum solution on two anodized aluminium substrates SAA and MAA. All the inkjet ink in the print heads was removed and prior to filling these print heads with the gum solutions, a cleaning step of the print heads was performed using a 90/10 wt % mixture of water/isopropanol.

The amount of gum solution jetted onto the SAA and MAA substrates was altered using the available printer settings of the Epson 900 printer: 1440 dpi and economy mode (the last one representing clearly a lower amount of gum solution).

The drying of the jetted samples was conducted by drying by air and at room temperature and was optionally followed by a heat treatment at 120° C. for 30 minutes.

In some cases an extra step was carried out before the drying step, which consisted of transporting the jetted samples through a pair of pressing rollers.

For evaluating the clean-out properties, samples were prepared on a MAA or a SAA substrate according to Table 2. In comparative samples COMP-1 and COMP-2, no gumming step was applied. Comparative sample COMP-3 was gummed according to the standard procedure used in the printing industry by applying overall gum solution and transporting the plate through a wet roller pair followed by drying. The inventive samples INV-1 to were prepared by jetting the gum solution using the available printer settings of the Epson 900 printer, optionally using a roll pair and drying the samples according to Table 2. The inventive samples INV-2, INV-3, INV-8, INV-9, INV-11 and were twice jetted at 1440 dpi but only the inventive samples INV-3, INV-9 and INV-12 received a dry roller pair treatment before drying.

TABLE 2

| Sample | Gum solution | Sub-strate | Gumming method | Roll pair | Drying conditions |
|---|---|---|---|---|---|
| COMP-1 | None | MAA | — | — | — |
| COMP-2 | None | SAA | — | — | — |
| COMP-3 | 2 | MAA | Standard gumming | Yes | 47° C. |
| INV-1 | 1 | MAA | 1 × 1440 dpi | No | Air +120° C. |
| INV-2 | 1 | MAA | 2 × 1440 dpi | No | Air +120° C. |
| INV-3 | 1 | MAA | 2 × 1440 dpi | Yes | Air +120° C. |
| INV-4 | 2 | MAA | 1 × Economy | No | Air |
| INV-5 | 2 | MAA | 1 × Economy | Yes | Air |
| INV-6 | 2 | MAA | 1 × 1440 dpi | No | Air |
| INV-7 | 2 | MAA | 1 × 1440 dpi | Yes | Air |
| INV-8 | 2 | MAA | 2 × 1440 dpi | No | Air |
| INV-9 | 2 | MAA | 2 × 1440 dpi | Yes | Air |
| INV-10 | 1 | SAA | 1 × 1440 dpi | No | Air +120° C. |
| INV-11 | 1 | SAA | 2 × 1440 dpi | No | Air +120° C. |
| INV-12 | 1 | SAA | 2 × 1440 dpi | Yes | Air +120° C. |

The printing plates were then mounted on a Heidelberg sheet fed offset press to evaluate clean-out of a non-printing area. The results are given in Table 3.

The printing plates were then mounted on a Heidelberg sheet fed GTO46 offset press to evaluate clean-out of a non-printing area. The results are given in Table 3.

TABLE 3

| Sample | Optical Density after 10 prints | Optical Density after 1,000 prints |
|---|---|---|
| COMP-1 | >1.20 | >1.20 |
| COMP-2 | >1.20 | >1.20 |
| COMP-3 | 0.09 | 0.09 |
| INV-1 | 0.13 | 0.12 |
| INV-2 | 0.10 | 0.09 |
| INV-3 | 0.10 | 0.09 |
| INV-4 | 0.80 | 0.57 |
| INV-5 | 1.17 | 0.94 |
| INV-6 | 0.13 | 0.15 |
| INV-7 | 0.09 | 0.09 |
| INV-8 | 0.09 | 0.09 |
| INV-9 | 0.09 | 0.09 |
| INV-10 | 0.18 | 0.15 |
| INV-11 | 0.10 | 0.09 |
| INV-12 | 0.09 | 0.09 |

Table 3 clearly shows that in comparative samples and COMP-2, the absence of a hydrophilic protective layer results in high optical density in the non-printing area even after 1,000 prints, i.e., no clean-out at all. Inventive samples INV-1 to INV-3 using the more concentrated gum solution 1, teach that more gum solution whether or not using a roller pair results in a good clean-out. However, enough gum solution should be applied to exhibit good clean-out in the non printing areas as shown by the bad clean-out of the inventive samples INV-4 and INV-5 printed in economy mode and using a lower concentrated gum solution 2. Inventive samples INV-6 to INV-9 show that an increase in jetted gum solution or the use of a roller treatment improved the clean-out properties. Inventive samples INV-10 to show that different substrates can be used.

Example 2

This example shows the advantages when a lower amount of gum solution can be applied to the printing areas compared to the non-printing areas.

In a first step, a lithographic printing plate was prepared by jetting imagewise a printing liquid according to Table 4 on a MAA and a SAA substrate. The printing liquid, which rendered the printing plate imagewise ink-uptaking, was jetted with an Agfa prototype ink jet piezo print head at a setting of 360 dpi with a 3 pL drop volume. In the second step, the gum solution 2 of Example 1 was jetted overall onto the prepared printing plate.

TABLE 4

| Component | Amount in wt % |
|---|---|
| Zonyl ™ FSE | 2 |
| Propyleneglycol | 18 |
| Duasyn ™ Direct Turquoise Blue FRLSF | 1 |
| Water | 79 |

The gumming step was conducted in the same way as in Example 1, except that no roller pair was used. The inventive samples INV-13 to INV-16 prepared according to Table 5 were compared with the comparative samples COMP-1 and COMP-2 of Example 1, which had received no gumming and drying step at 120° C.

TABLE 5

| Sample | Gum solution | Substrate | Gumming method | Drying conditions |
|---|---|---|---|---|
| COMP-1 | None | MAA | — | — |
| COMP-2 | None | SAA | — | — |
| INV-13 | 2 | MAA | 1 × 360 dpi | Air + 120° C. |
| INV-14 | 2 | MAA | 2 × 360 dpi | Air + 120° C. |
| INV-15 | 2 | SAA | 1 × 360 dpi | Air + 120° C. |
| INV-16 | 2 | SAA | 2 × 360 dpi | Air + 120° C. |

The results for the speed of ink-uptake in the printing areas of the printing plate and the fingerprint test evaluation are given in Table 6 after printing 10 sheets of paper.

TABLE 6

| Sample | Optical density on print no. 10 | Fingerprint test |
|---|---|---|
| COMP-1 | >1.20 | Not possible |
| COMP-2 | >1.20 | Not possible |
| INV-13 | 0.32 | − |
| INV-14 | 0.12 | + |
| INV-15 | 0.31 | − |
| INV-16 | 0.10 | + |

Table 6 shows that ink-uptake is delayed by jetting a high amount of gum solution onto the printing plate, but on the other hand a high amount of gum solution is required for low fingerprint sensitivity in the non-printing areas. An evaluation of the fingerprint test was not possible for comparative samples COMP-1 and COMP-2, due to the high optical density in the absence of gum.

Therefore, it can be readily seen that jetting the gumming solution anti-imagewise would result in fast ink-uptake of the printing plate in the printing areas and thorough clean-out in the non-printing areas.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. A method for gumming a lithographic printing plate comprising the steps of:

a) providing a lithographic printing plate including a lithographic image consisting of printing areas and non-printing areas; and b) jetting a gum solution with an inkjet printer to produce a hydrophilic protective layer on the non-printing areas; wherein the gum solution is jetted on the printing areas such that a thickness of the hydrophilic protective layer on the non-printing areas is greater than a thickness of the hydrophilic protective layer on the printing areas.

2. A method for gumming a lithographic printing plate according to claim 1, wherein the gum solution is jetted only on the non-printing areas by first detecting the printing areas.

3. A method for gumming a lithographic printing plate according to claim 2, wherein the printing areas are detected with an optical measurement device.

4. A method for gumming a lithographic printing plate according to claim 1, wherein the lithographic printing plate is produced from a heat-sensitive lithographic printing plate precursor or a radiation-sensitive lithographic printing plate precursor.

5. A method for gumming a lithographic printing plate according to claim 1, wherein the lithographic printing plate is produced by inkjet printing on a printing plate precursor.

6. A method for gumming a lithographic printing plate according to claim 5, wherein the gum solution and a fluid for the formation of the printing areas of the lithographic image are jetted on the printing plate precursor in the same inkjet printing process.

7. A method for gumming a lithographic printing plate according to claim 6, wherein the gum solution and the fluid for the formation of the printing areas of the lithographic image are jetted on the printing plate precursor by the same inkjet print head.

8. A method for gumming a lithographic printing plate according to claim 1, wherein step b) is carried out after first printing with the lithographic printing plate.

9. A method for gumming a lithographic printing plate according to claim 1, wherein the inkjet printer is mounted on a printing press.

10. A method for gumming a lithographic printing plate according to claim 1, wherein the inkjet printer includes at least one roller pair arranged to press the lithographic printing plate to ensure thorough clean-out of the non-printing areas.

* * * * *